United States Patent [19]

Duve

[11] Patent Number: 4,829,146

[45] Date of Patent: May 9, 1989

[54] METALLIC COUPLING SYSTEM

[75] Inventor: Wolfgang Duve, Hackettstown, N.J.

[73] Assignee: Amerace Corporation, Parsippany, N.J.

[21] Appl. No.: 179,957

[22] Filed: Apr. 11, 1988

[51] Int. Cl.[4] ..... H01R 4/58

[52] U.S. Cl. ..... 174/94 R; 174/84 C; 174/90; 403/278; 403/305; 439/877

[58] Field of Search ..... 174/84 C, 90, 94 R; 439/877; 16/108; 403/278, 285, 305

[56] References Cited

U.S. PATENT DOCUMENTS

| | | | |
|---|---|---|---|
| 2,188,178 | 1/1940 | Eby | 174/90 |
| 2,799,721 | 7/1957 | Floyd, Jr. | 174/84 C |
| 3,033,600 | 5/1962 | Drysdale | 174/94 R |
| 3,052,750 | 9/1962 | Cobaugh | 174/90 |
| 3,125,630 | 3/1964 | Wahl | 174/90 |
| 3,184,535 | 5/1965 | Worthington | 174/94 R |
| 3,996,417 | 12/1976 | Annas | 174/90 |

*Primary Examiner*—Morris H. Nimmo

*Attorney, Agent, or Firm*—David Teschner

[57] ABSTRACT

A conductive metal coupling sleeve harder and springier than the conductor and connector to be joined is interposed between them. The sleeve having patterned inside and outside surfaces is placed over the conductor end and the conductor-sleeve combination is inserted into the bore of the desired connector and subjected to compressing forces to crimp the components together. The patterns of the sleeve interlock with the conductor and the walls that define the connector bore. The springiness of the sleeve insures good electrical conductivity between the components in the event there is some springback of the components upon the termination of assembly compression or creep during use.

20 Claims, 4 Drawing Sheets

METALLIC COUPLING SYSTEM

BACKGROUND OF THE INVENTION

1. Field of the Invention

The invention pertains to the mechanical coupling of solid metallic connectors to solid or compacted metallic conductors and more particularly to the termination or coupling of solid or compacted aluminum or solid or compacted copper conductors to provide good mechanical strength and high electrical conductivity between such conductors and connectors.

2. Description of the Prior Art

According to the prior art solid and stranded conductors of aluminum and copper are joined to similar conductors or terminated in connectors of similar metals, i.e. aluminum conductors to aluminum conductors using aluminum splicers or aluminum conductors to aluminum terminators—by crimping or compacting the metal of the connector and the metal of the conductor, inserted into a suitable bore in the connector, into as compacted and solid a mass as possible. The crimping may be by the use of circular dies which compress the metal mass uniformly over the entire perimeter of the compression zone or by hexagonal nested dies with their own compression pattern. If the hardness of the conductor and connector are the same and the modulus of elasticity is the same and there is no springback, the compressed mass will remain the way it was when the compression was completed.

However, if the conductor is harder than the connector, the crimping tool will not deform the conductor and the conductor can be withdrawn from the connector. Conversely, if the connector is harder than the conductor, the connector would exhibit a springback due to the original hardness of the connector itself which would try to return to its former state resulting in an incomplete mechanical and a high-impedance electrical connection between the conductor and connector.

In U.S. Pat. No. 3,033,600 issued May 8, 1962, a sleeve or insert 3 is placed upon the end of a wire 7 inserted into the bore in a shell 1. The insert 3 is hollow and split partially as by the use of slots 6. The outer surface of insert 3 is formed with serrations 4 and a screwthreaded interior surface 5. The shell 1, insert 3 and wire 7 are assembled by cold swagging "in a hydraulic press or other suitable apparatus furnished with appropriately-shaped dies, the pressing being completed in one or more operations depending upon the capacity of the press available."As a result "the projections of the internal screwthreads 5 of the inserts 3 to bite into or grip the wires 7 to be joined, the inserts themselves being retained in the sleeve 1 because of the knurling, serrations or the like 4 co-acting with the bores of the sleeve to form indentations therein . . . the ends of the sleeve 1 are upset or contoured into close proximity or engagement with the wires 7 to form a substantially weatherproof seal and still further increase the efficiency of the connector."

The patent is only concerned with the mechanical joining of wires, rods and the like and not the electrical coupling of conductors and connectors and no mention is made of the electrical properties of the joint. Further, no mention is made of the relative hardness and springiness of the component parts.

U.S. Pat. No. 3,184,535 issued May 18, 1965 is similar to the '600 patent but includes multiple bores, each intended to handle one portion of a multi-part wire. For example, in FIG. 1, sleeve 1 has smaller diameter bores adjacent midfeather 5 to handle the cable cores and larger diameter bores adjacent the sleeve 1 ends to accommodate the surrounding cable strands. Each bore accepts a suitably sized insert 2 formed similarly to that described in the '600 patent and the overall device is also similarly assembled in a suitable tool.

In U.S. Pat. No. 3,996,417 issued Dec. 7, 1976, a core grip 4 having external lobes 6 (see FIGS. 2 and 3) is used to couple the core 14 of a core reinforced cable 10, the strands 12 of which are gripped by the wall 22 of a compression barrel 20 into which cable 10 is inserted.

No mention is made in the '535 or '417 patents of the needs of an electrically conductive joint nor is there any mention made of the relative hardness or springiness of the cable, core, strands, insert or shell.

SUMMARY OF THE INVENTION

The present invention overcomes the difficulties noted above with respect to the prior art by providing a coupling sleeve between the connector and the conductor. This coupling sleeve is made of a conductive material which is harder than either the connector or the conductor. This sleeve is also more springy than the connector and the conductor. The inside and outside surfaces of the sleeve are provided with a surface pattern to form an interlocking engagement between all three components when the connector is crimped. The spring action of the coupling sleeve provides for interconnection of the conductor and the connector even though the connector may have springback after crimping. It is an object of the invention to provide an improved device for crimping solid or compacted conductors and connectors together to provide improved mechanical assembly and electrical continuity.

It is an object of the invention to provide a coupling sleeve between a solid metal connector and a solid or compacted metal conductor inserted into a bore within said connector which provides improved mechanical assembly of the connector and conductor and improved electrical continuity therebetween.

It is still another object of the invention to provide a coupling sleeve having a hardness and springiness each greater than that of a solid metal connector to be joined with a metal conductor inserted within the bore of such connector.

It is another object of the invention to provide a dependable crimp connection between the connector and conductor regardless of their relative hardness.

It is yet another object of the invention to provide a coupling sleeve having a generally cylindrical shape with an inside and outside surface patterned to interlock with a metal connector and a metal conductor about which such sleeve is placed when inserted into a bore in said connector and the assembled elements are compressed in a suitable crimping tool.

It is still another object of the invention to provide a coupling sleeve having a generally cylindrical shape the walls of which are fluted in a direction along the longitudinal axis of said sleeve.

It is still another object of the invention to provide a coupling sleeve having a generally cylindrical shape with an inside and outside surface patterned to interlock with a metal connector and a metal conductor about which such sleeve is placed when inserted into a bore in said connector and the assembled elements are compressed in a suitable crimping tool, said sleeve having a hardness and springiness each greater than that of the solid metal connector to be joined with the metal conductor to provide improved mechanical assembly and electrical conductivity.

Other objects and features of the invention will be pointed out in the following description and claims and illustrated in the accompanying drawings which disclose, by way of example, the principles of the invention and the best modes which have been contemplated for carrying them out.

BRIEF DESCRIPTION OF THE DRAWING

In the drawing in which similar elements are given similar reference characters.

DESCRIPTION OF THE PREFERRED EMBODIMENT

Figure 1:
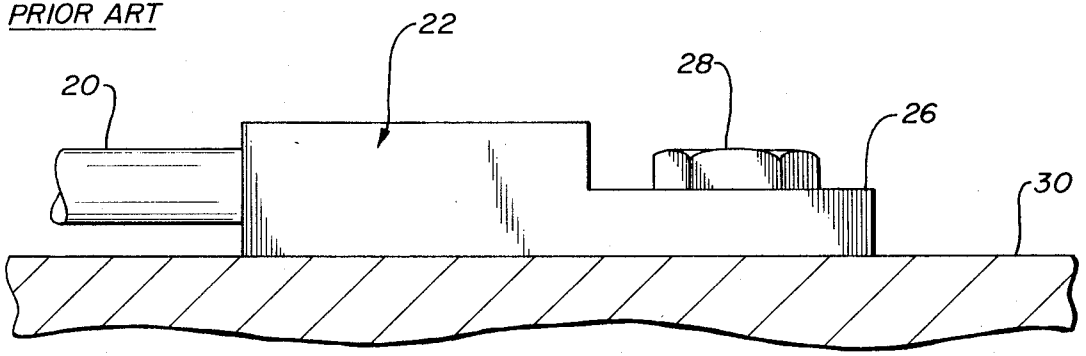
FIG-1 PRIOR ART
FIG. 1 is a fragmentary side elevation of the termination of an electrical conductor which in turn is bolted to a bus bar according to the prior art.
Figure 4:
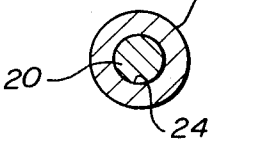
FIG-4 PRIOR ART
FIG. 4 is an end view, in section, of the completed joint between the splicer and conductor taken along the line 4—4 in FIG. 2 after annular compression using round dies according to the prior art.

Turning now to FIGS. 1 to 5, there are shown typical prior art terminations and connections of electrical conductors. In FIG. 1, conductor 20 is suitably crimped in the bore (not shown) of a terminal connector 22 using circular dies in an appropriate crimping tool (not shown) to appear substantially as shown in FIG. 4. As stated above, the desire is to crimp the connector 22 and conductor 20 into a compressed, unified mass uniting the metal of the connector with that of the conductor. Unfortunately, as also set forth above the relative hardness and springiness of these components may prevent the desired result and leave the components subject to separation or at least a poor mechanical and electrical joint.

Figure 5:
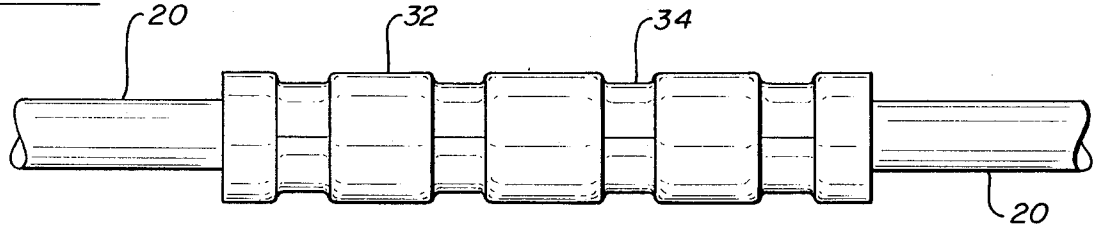
FIG-5 PRIOR ART
FIG. 5 is a fragmentary side elevation of the assembly of two conductors using a splicer compressed at a number of locations using hexagonal dies according to the prior art.
Figure 6:
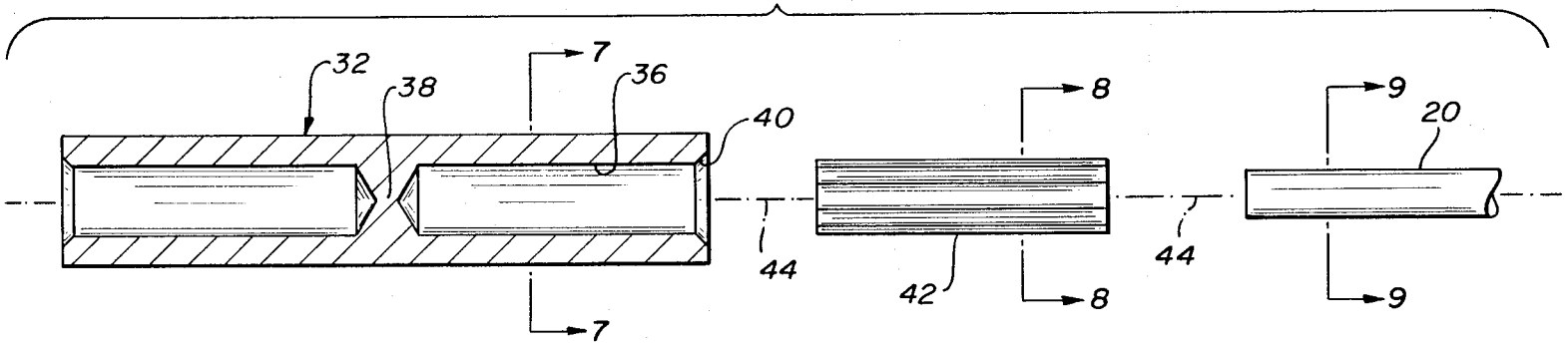
FIG. 6 is an exploded side elevation, partly in section, showing the components of the coupling system constructed in accordance with the concepts of the invention.
Figure 9:
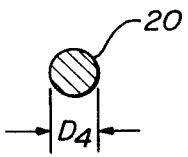
FIG. 9 is an end view, in section, of the conductor of FIG. 6 taken along the lines 9—9.
Figure 8:
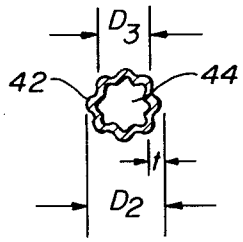
FIG. 8 is an end view, in section, of the coupling sleeve of FIG. 6 taken along the lines 8—8.
Figure 7:
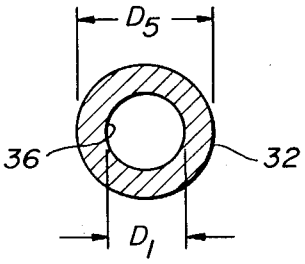
FIG. 7 is an end view, in section, of the splicer of FIG. 6 take along the lines 7—7.

As an alternate to the overall circular compression shown in FIG. 4 the splicer 32 and conductors 20 could be compressed at selected positions using hexagonal dies as shown in FIG. 5 by bands 34 or even circular dies (not shown) could be used giving circular compression bands. The amount of connector surface compressed or the number and location of compression bands will depend upon the size and length of the connector and conductors.

The connector 22 of FIG. 1 includes a ring terminal 26 having an aperture therethrough (not shown) by which bolt 28 may be used to couple ring terminal 26 to bus bar 30.

Figure 2:
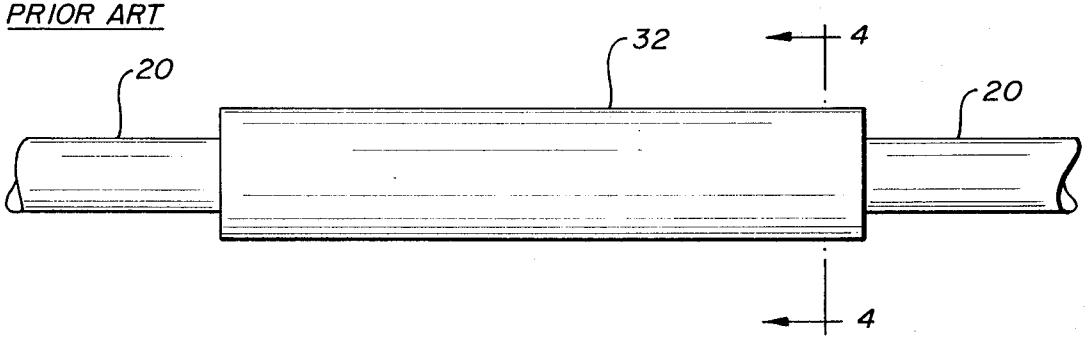
FIG-2 PRIOR ART
FIG. 2 is a fragmentary side elevation of the joining of two electrical conductors by means of a splicer according to the prior art.
Figure 3:
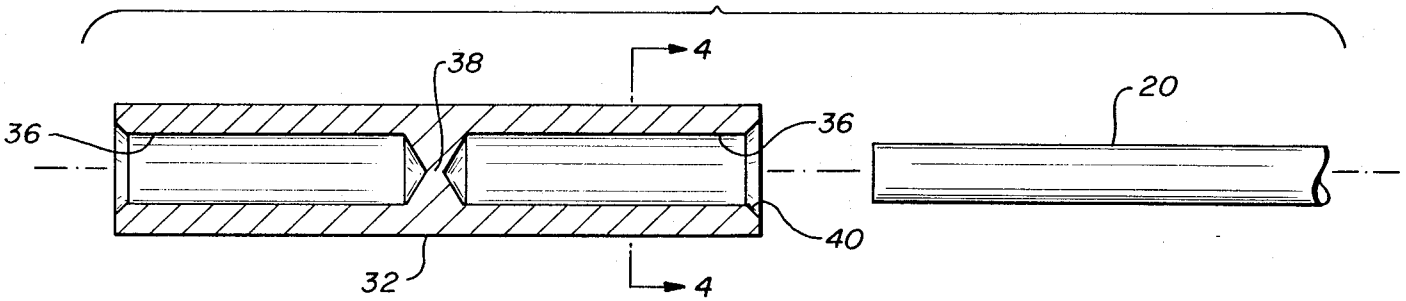
FIG-3 PRIOR ART
FIG. 3 is a fragmentary side elevation of the splicer of FIG. 2, in section, and showing one of the conductors to be joined prior to insertion into the splicer according to the prior art.

Splicer 32 used to join two conductors 20, as shown in FIG. 2 is a generally cylindrical rod having bores 36 extending inwardly from opposite edges to a midfeather 38 which divides the splicer 32 in half providing equal length bores 36 for receipt of the two conductors 20. A counterbore 40 at the entrance to each bore 36 provides easy access to such bores. FIG. 5 shows that two hexagonal compression bands 34 were used to crimp the splicer 32 to each conductor 20. The number, location and degree of compression being chosen based upon the size of the conductor, the splicer and the load on the conductors among other factors.

Turning now to FIGS. 6 to 15, the concepts of the present invention are set forth. A splicer 32 similar to the one used in the prior art is also used herein as well as a conductor 20. The invention adds a coupling sleeve 42 intermediate the conductor 20 and the connector 32. The coupling sleeve 42 fits over the conductor 20 and is positioned with the conductor 20 in the bore 36 of the connector 32.

Figure 10:
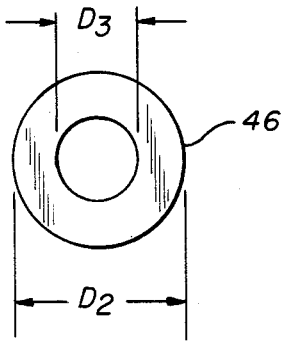
FIG. 10 is and end view of an alternative form of coupling sleeve constructed in accordance with the concepts of the invention.
Figure 11:
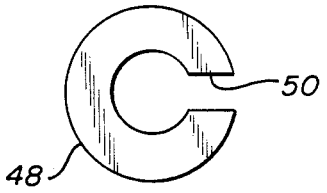
FIG. 11 is an end view of a further embodiment of a coupling sleeve constructed in accordance with the concepts of the invention.

The coupling sleeve 42 is generally cylindrical having an outside diameter $D_2$ (see FIG. 8) less than the inside diameter $D_1$ (see FIG. 7) of the bore 36 of splicer 32 and an inside diameter $D_3$ (see FIG. 8) greater than the outside diameter $D_4$ of the conductor 20. The coupling sleeve 46 of FIG. 10 represents a somewhat simpler case since it is a simple tube having an outside diameter $D_2$ equal to the outside diameter of sleeve 42, and an inside diameter $D_3$ equal to the inside diameter of sleeve 42 but having a solid wall of greater thickness than the wall of sleeve 42. The relative sizes of the connector or splicer 32, the coupling sleeve 46 and the conductor 20 is shown in the following table of typical dimensions.

| Component | Outside Diameter (Inches) | Inside Diameter (Inches) |
|---|---|---|
| Connector 32 (round barrel) | 0.880 | 0.586 |
| Coupling sleeve 46 | 0.540 | 0.480 |
| Conductor 20 | 0.460 | |

The coupling sleeve 46 in this configuration has a nominal thickness of 0.030 inches and may be in the range of approximately 0.030 to 0.035 inches. A clearance of 0.020 inches is provided on the inside diameter to accept the circular conductor 20. The inside diameter of connector 32 provides a clearance of 0.046 inches. This clearance space between conductor 20 outer surface and connector 32 bore 36 defining wall is about twelve to sixteen percent (12%–16%) of the cross-sectional area of the bore 36.

The coupling sleeve 42 achieves the same result as sleeve 46 with thinner metal stock which can be formed up out of flat stock. Flat stock of approximately 0.012 to 0.016 inches is fluted along its longitudinal axis 44 to have an effective wall thickness of 0.030 to 0.035 inches, giving an overall outer diameter $D_2$ equal to 0.540 inches and an inside diameter $D_3$ equal to the range of 0.470 to 0.480 inches. The flat stock when rolled up would be seamed along the marginal edges since the flexibility of the flutes and the springiness of the metal would serve to make the required contact with the walls defining bore 36 of connector 32. To provide for the desired springiness the coupling sleeve 48 of FIG. 11 could be formed by rolling up flat metal stock of the desired thickness and springiness but leaving an open seam as at 50 to increase the ability of sleeve 48 to conform to the crimped state of connector 32.

To enhance the ability of the coupling sleeves 42, 46, 48 to interlock with the metal of the conductor 20 and the walls defining the bore 36 of connector 32 the inside and outside surfaces of the sleeves are patterned and of sufficient depth that the projections and valleys facilitate interlocking of the contacting metal surfaces. The pattern can be formed by rolling, stamping, blanking, coining, embossing, machining or etching using techniques well known in the metal working art.

Figure 12:
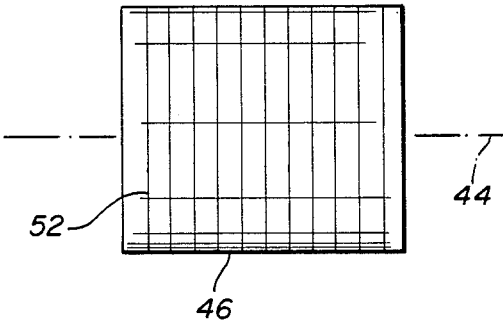
FIG. 12 is a top plan view of one form of surface treatment usable on either or both of the inside and outside surfaces of the coupling sleeve constructed in accordance with the concepts of the invention.
Figure 13:
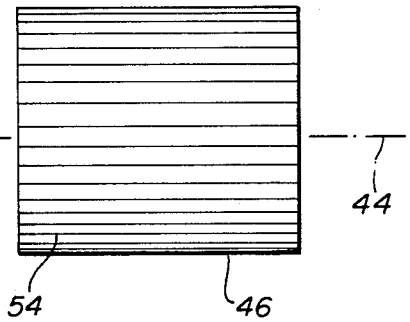
FIG. 13 is a top plan view of another form of surface treatment for the coupling sleeve.
Figure 14:
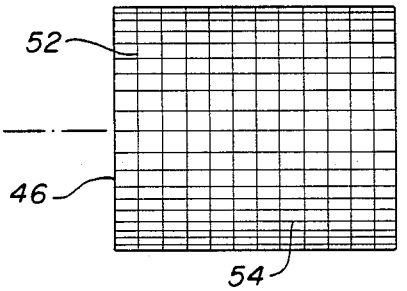
FIG. 14 is a top plane view of yet another form of surface treatment for the coupling sleeve.
Figure 15:
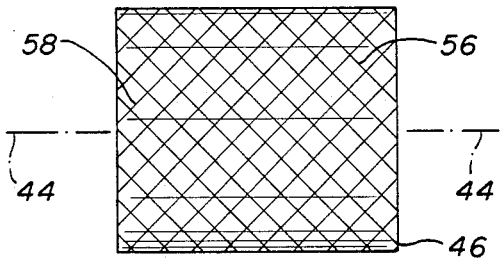
FIG. 15 is a top plan view of still another form of surface treatment for the coupling sleeve.

The pattern to be formed on sleeve 46, for example, can be circumferential as in FIG. 12 where the ridges 52 extend transverse to the longitudinal axis 44 or along the longitudinal axis 44 as with ridges 54 in FIG. 13. Also a combination of ridges 52 and 54 running respectively transverse to and parallel with the longitudinal axis 44 can be employed as in FIG. 14 or ridges 56, 58 set at diagonals to the longitudinal axis 44 as set out in FIG. 15. Single diagonal ridge sets, such as 56 and 58 could also be employed.

The metal used for the connector 32 is generally solid aluminum and for the conductor 20 is generally solid or compacted stranded aluminum which has been partially cold worked or annealed. The metal of the coupling inserts 42, 46 and 48 is a heat treatable series aluminum alloy such as 6061T6 as defined by the aluminum association. The particular conductor, connector and coupling sleeve employed had the following hardness and springiness. The hardness was tested on a Brinell Hardness Testor using a 500K gram load and a 10 mm ball. The Brinell hardness numbers recorded are listed below. The ultimate tensile strength and yield strength of the metals employed, taken from the ASTM standards are also listed.

| Component | Strength (in 000 psi) Ultimate | Yield | Hardness Brinell No. |
|---|---|---|---|
| Conductor 20 | 12–27 | 4–24 | 19–40 |
| Connector 32 | 10–19 | 4–18 | 19–40 |
| Sleeve 42 | 45 | 40 | 95 |

The above example is given for a solid aluminum conductor and is generally the same for compacted aluminum except that the diameter $D_4$ will be somewhat larger. However, the same-sized connector may be employed in that its range will accept the same designated compacted conductor. Thus a connector 32 for a 2/O solid aluminum conductor will also accept a 2/O compacted aluminum conductor.

In the event that the metal used for the conductor 20 and the connector 32 is solid or compacted copper, the copper will also be partially cold worked or annealed. The metal of the coupling inserts 42, 46 and 48 is a heat-treatable copper alloy such as berylium copper, alloy C17500 as defined by the Copper Development Association. The particular conductor, connector and coupling sleeve employed had the following hardness and springiness. The hardness was tested on a Brinell Hardness Tester using a 500K gram load and a 10 mm ball. The Brinell hardness number recorded are listed below as are the ultimate tensile and yield strengths of the metals employed.

| Component | Strength (in 000 psi) Ultimate | Yield | Hardness Brinell No. |
|---|---|---|---|
| Conductor 20 | 34–60 | 11–55 | 79–95 |
| Connector 32 | 34–50 | 11–44 | 79–95 |
| Sleeve 42 | 110 | 90 | 163 |

Thus, using a conductive coupling sleeve having a hardness and springiness greater than either the conductor or connector to be joined and by placing a pattern on the inside and outside surfaces of such coupling sleeve a more complete and reliable mechanical and electrical coupling can be achieved. The pattern of the harder sleeve providing for the interlocking of the metal components and the springiness of the sleeve insuring electrical contact in the event some separation should occur due to metal springback after the assembly crimping operation has terminated or due to creepage of the joint in use.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. In a metallic coupling system including a conductor of solid or compacted metal having a first hardness and a first modulus of elasticity, the conductor having an outer surface with an outside diameter, and a connector having a wall of solid metal with at least one bore therein including an inside diameter and a length to receive said conductor therein, the metal of said connector having a second hardness and a second modulus of elasticity, an improvement for facilitating the electrical and mechanical joining of the conductor and the connector, the improvement comprising: a coupling sleeve of metal, the coupling sleeve having a generally hollow, cylindrical shape with an outside surface having a diameter less than said inside diameter of said bore of said connector, an inside surface having a diameter greater than said outside diameter of said conductor and a length substantially equal to the length of said connector bore; said inside and outside surfaces of said coupling sleeve being patterned and the metal of said coupling sleeve having a third hardness and a third modulus of elasticity each respectively greater than said first and second hardness and modulus of elasticity whereby upon the compression of said connector upon said conductor with said coupling sleeve interposed therebetween said pattern of said inside surface of said coupling sleeve will bite into and interlock with the outer surface of said conductor and the outside surface of the coupling sleeve will engage the wall of said connector to provide an electrical and mechanical joint between said conductor, connector and coupling sleeve.

2. In a metallic coupling system as defined in claim 1, wherein said inside and outside surfaces of said coupling sleeve are fluted along the longitudinal axis of said sleeve.

3. In a metallic coupling system as defined in claim 1, wherein said coupling sleeve comprises a split-seamed, generally cylindrical form, said split extending in parallel with the longitudinal axis of said sleeve.

4. In a metallic coupling system as defined in claim 1, wherein said pattern on said inside and outside surfaces is a series of surface configuration extending in parallel with the longitudinal axis of said sleeve.

5. In a metallic coupling system as defined in claim 1, wherein said pattern on said inside and outside surfaces is a series o surface configurations extending transverse with respect to the longitudinal axis of said sleeve.

6. In a metallic coupling system as defined in claim 1, wherein said pattern on said inside and outside surfaces is a series of surfaces configuration some of which extend in parallel with the longitudinal axis of said sleeve and longitudinal axis of said sleeve.

7. In a metallic coupling system as defined in claim 1, wherein said pattern on said inside and outside surfaces extend diagonally with respect to the longitudinal axis of said sleeve.

8. In a metallic coupling system as defined in claim 1, wherein said conductor and connector are aluminum and are partially coldworked or annealed and said sleeve is a heat treatable series aluminum alloy.

9. In a metallic coupling system as defined in claim 8, wherein the ultimate tensile strength of said conductor is in the range of 12,000 to 27,000 psi, of said connector is in the range of 10,000 to 19,000 psi and said sleeve is approximately 45,000 psi.

10. In a metallic coupling system as defined in claim 8, wherein the yield strength of said conductor is in the range of 4,000 to 24,000 psi, of said connector is in the range of 4,000 to 18,000 psi and said sleeve is approximately 40,000 psi.

11. In a metallic coupling system as defined in claim 9, wherein the yield strength of said conductor is in the range of 4,000 to 24,000 psi, of said connector is in the range of 4,000 to 18,000 psi and said sleeve is approximately 40,000 psi.

12. In a metallic coupling system as defined in claim 8, wherein the hardness of each of said conductor and said connector is in the range of 19 to 40 measured in the Brinell scale using a 500 kilogram load with a 10 mm ball and the sleeve has a hardness of 95 on said same Brinell scale.

13. In a metallic coupling system as defined in claim 10, wherein the hardness of each of said conductor and said connector is in the range of 19 to 40 measured on the Brinell scale using a 500 kilogram load with a 10 mm ball and the sleeve has a hardness of 95 on said same Brinell scale.

14. In a metallic coupling system as defined in claim 1, wherein the cross-sectional area of said bore of said connector exceeds the cross-sectional area of said conductor by twelve to sixteen percent and is substantially filled by the cross-sectional area of said sleeve.

15. In a metallic coupling system as defined in claim 1, wherein said conductor and connector are copper and are partially coldworked or annealed and said sleeve is a heat-treatable copper alloy.

16. In a metallic coupling system as defined in claim 15, wherein the ultimate tensile strength of said conductor is in the range of 34,000 to 60,000 psi, of said connector is in the range of 34,000 to 50,000 psi and said sleeve is approximately 110,000 psi.

17. In a metallic coupling system as defined in claim 15, wherein the yield strength of said conductor is in the range of 11,000 to 55,000 psi, of said connector is in the range of 11,000 to 44,000 psi and said sleeve is approximately 90,000 psi.

18. In a metallic coupling system as defined in claim 16, wherein the yield strength of said conductor is in the range of 11,000 to 55,000 psi, of said connector is in the range of 11,000 to 44,000 psi and said sleeve is approximately 90,000 psi.

19. In a metallic coupling system as defined in claim 15, wherein the hardness of each of said conductor and said connector is in the range of 79 to 95 measured in the Brinell scale using a 500 kilogram load with a 10 mm ball and the sleeve has a hardness of 163 on said same Brinell scale.

20. In a metallic coupling system as defined in claim 17, wherein the hardness of each of said conductor and said connector is in the range of 79 to 95 measured on the Brinell scale using a 500 kilogram load with a 10 mm ball and the sleeve has a hardness of 163 on said same Brinell scale.

* * * * *

UNITED STATES PATENT AND TRADEMARK OFFICE

CERTIFICATE OF CORRECTION

PATENT NO. : 4,829,146

DATED : May 9, 1989

INVENTOR(S) : Wolfgang Duve

It is certified that error appears in the above—identified patent and that said Letters Patent is hereby corrected as shown below:

In the Specification:

Col. 3, line 39, change "take" to --taken--.

In the Claims:

Col. 7, line 22, change "configuration" to --configurations--.
line 26, change "o" to --of--.
line 30, change "configuration" to --configurations--.
line 32, after the word "and" insert --others of which extend transversely with respect to the--.

Signed and Sealed this

Twenty-second Day of May, 1990

*Attest:*

HARRY F. MANBECK, JR.

*Attesting Officer*

*Commissioner of Patents and Trademarks*